US005783536A

United States Patent [19]

Farrell et al.

[11] Patent Number: 5,783,536

[45] Date of Patent: Jul. 21, 1998

[54] BAR COMPOSITION COMPRISING ADDITIVE FOR DELIVERING BENEFIT AGENT

[75] Inventors: Terence Farrell, Guttenberg; Georgia Shafer, Rutherford; James Dalton, Cliffside Park, all of N.J.

[73] Assignee: Lever Brothers Company, Division of Conopco, Inc., New York, N.Y.

[21] Appl. No.: 670,887

[22] Filed: Jun. 26, 1996

[51] Int. Cl.[6] ..... C11D 9/36; C11D 17/00; C11D 3/12

[52] U.S. Cl. ..... 510/141; 510/152; 510/153; 510/155; 510/156; 510/440; 510/447; 510/451; 510/466; 510/495; 510/484; 510/486; 510/504; 510/511

[58] Field of Search ..... 510/141, 152, 510/153, 155, 156, 440, 447, 451, 466, 495, 504, 511, 484, 486

[56] References Cited

U.S. PATENT DOCUMENTS

| | | | |
|---|---|---|---|
| 3,933,672 | 1/1976 | Bartolotta et al. | 510/438 |
| 4,652,392 | 3/1987 | Baginski et al. | 510/438 |
| 4,732,694 | 3/1988 | Gowland et al. | 510/306 |
| 4,810,413 | 3/1989 | Pancheri et al. | 510/320 |
| 4,927,557 | 5/1990 | Revis et al. | 510/513 |
| 5,154,849 | 10/1992 | Visscher et al. | 510/150 |
| 5,260,051 | 11/1993 | Cho | 424/57 |
| 5,336,427 | 8/1994 | Bunczk et al. | 510/192 |
| 5,510,049 | 4/1996 | Connor et al. | 510/323 |

*Primary Examiner*—Douglas J. McGinty
*Assistant Examiner*—Lorna M. Douyon
*Attorney, Agent, or Firm*—Ronald A. Koatz

[57] ABSTRACT

An extruded toilet bar composition comprises mixtures of chips containing polyalkylene glycol, benefit agent and fumed silica, and chips containing a surfactant system.

9 Claims, 1 Drawing Sheet

BAR COMPOSITION COMPRISING ADDITIVE FOR DELIVERING BENEFIT AGENT

FIELD OF THE INVENTION

The present invention relates to bar compositions, particularly synthetic soap bar compositions, able to deliver beneficial agents (e.g., silicone) in higher amounts than previously possible. In particular, the invention relates to additive compositions (e.g., soap chips) comprising a benefit agent which are then mixed with non-beneficial agent chips prior to milling, extruding and stamping the bars. The invention further relates to a method of making the additives.

BACKGROUND OF THE INVENTION

It has long been a desirable goal to deliver some kind of benefit agent (e.g., silicone or other oils) to the skin through a personal wash composition.

In liquid cleansers, for example, cationic hydrophilic polymers such as Polymer JR® from Amerchol or Jaguar® from Rhone Poulenc have been used to enhance delivery of benefit agents (EP 93,602; WO 94/03152; and WO 94/03151). In applicants' copending application, U.S. Ser. No. 08/412,803 to Tsaur et al., separate hydrogel particles act as a structure to entrap the benefit agent in concentrated form.

Delivery of benefit agents (e.g., silicone) in bar compositions has proven much more difficult for a number of reasons. If the benefit agent is soluble in any component of the bar composition, for example, it may simply solubilize into these components during the batch mixing phase (prior to cooling and chip formulation) and either no benefit agent or an insufficient amount of benefit agent will be present in the final bar (after milling, plodding and extrusion of chips) to be delivered to the skin. The overly soluble benefit agent may also reduce viscosity and cause improper mixing. If the benefit agent is too viscous, on the other hand, it tends to get in the processing equipment and become too difficult to process.

U.S. Pat. No. 5,154,849 to Visscher et al. teaches bar compositions containing a silicone skin mildness/moisturizing aid component. In one embodiment, the silicone component may be mixed with a carrier which is selected to facilitate incorporation of the silicone. Preferred carrier is said to be polyethylene glycol. At column 16, the reference describes that silicone is mixed into melted Carbowax (polyethylene glycol), that the mixture is cooled to form flakes, and that the flakes are preferably added to an amalgamator.

It is clear, however, that the Visscher et al. reference contemplates a silicone/carrier system different from the benefit agent/carrier/fumed silica system of the subject invention. First, the Visscher patent does not teach fumed silica, a critical component of the additive compositions and one which is believed to provide the structure required to retain and engulf the benefit agent (e.g., silicone). Second, as suggested above and as shown in FIGS. 1 and 2, the structure of the carrier/silicone chip is distinct. The Visscher et al. chip does not contain the silicone in discrete droplets, but rather the silicone oozes and surrounds the carrier. By contrast, the benefit agent droplets of the invention are discrete droplets retained within the chip. This helps to ensure the silicone does not ooze and interfere with processing.

The discrete particles of the invention, in turn, are present for two reasons, it is believed. The first, as noted above, is presence of fumed silica which, while not wishing to be bound by theory, it is believed helps to work with the carrier (i.e., PEG) to better entrap the silicone. The second is that, unlike the Visscher et al. system, the present invention requires there be an equal amount or more of carrier relative to the benefit agent. By contrast, it appears from Visscher et al., where eleven pounds of silicone (column 15, lines 1–2), are mixed with 5 to 6 pounds of Carbowax (column 15, line 29) that there is probably an excess of silicone to PEG and, at the least, there is no recognition of the criticality of having an equal amount or more of PEG to silicone.

In short, the chips of the Visscher reference are extremely difficult to process both because there is no control over the amount of silicone used and because there is no use of fumed silica.

SUMMARY OF THE INVENTION

Unexpectedly, applicants have found that, when specific additives are made containing an equal amount or greater of polyalkylene glycol to benefit agent and further containing fumed silica, the benefit agent (e.g., silicone) is prepared in the form of discrete droplets which in turn allow the benefit agent to be much more readily processed.

Specifically, the invention comprises a chip composition comprising:

(a) 40% to about 80% by wt. of the chip composition of a polyalkylene glycol having a molecular weight greater than about 4,000, preferably 5,000 to 20,000, more preferably 5,000 to 10,000;

(b) 10% to 40% by wt. of the chip composition of benefit agent (e.g., silicone);

(c) 0.01% to 10% by wt. chip composition fumed silica;

(d) 0.0% to 10% by wt. chip composition, preferably 0% to 5% by wt. water; and (e) 0% to 15% by wt. chip composition $C_8$ to $C_{22}$ fatty acid.

In a second embodiment of the invention, the invention comprises an extruded bar composition produced using about 20% to 40% chips as described above and about 80% to 60% chips comprising about 5% to 90% by wt. of a surfactant system wherein the surfactant is selected from the group consisting of soap, anionic surfactant, nonionic surfactant, amphoteric surfactant, zwitterionic surfactant, cationic surfactant and mixtures thereof. The "soap and/or surfactant" chips additionally may comprise other components typically found in such chips such as, for example, minor amounts of fragrance, preservative (e.g., butylated hydroxy toluene) skin feel polymer (e.g., guar) etc.

Although the surfactant system of the second (non-additive containing) chip may be a pure soap surfactant system, preferably the surfactant system comprises:

(a) a first synthetic surfactant which is an anionic surfactant; and (b) a second synthetic surfactant selected from the group consisting of a second anionic different from the first, a nonionic, an amphoteric and mixtures thereof.

A particularly preferred surfactant system comprises acyl isethionate as the first anionic and a sulfosuccinate or a betaine surfactant or mixtures of the two.

In a third embodiment of the invention, the invention comprises a method of making benefit agent containing chips comprising:

(a) 40% to 80% polyalkylene glycol;

(b) 10% to 40% benefit agent;

(c) 0.01% to 10% fumed silica;

(d) 0% to 10% water; and (e) 0% to 10% $C_8$ to $C_{22}$ fatty acid; which method comprises mixing the ingredients at temperatures above the melting point of polyalkylene glycol (i.e., above about 50° C.) for 1 to 60 minutes; cooling on a chill roll (at about 0° to 25° C.); and collecting.

DETAILED DESCRIPTION OF THE INVENTION

In one embodiment of the invention, the present invention relates to novel soap chip compositions (e.g., in the process for making bars, molten compositions are formed which are then cooled on what is commonly called a chill roll to form flakes or chips; these chips are subsequently refined and/or plodded to form billets which are stamped and cut to form final bars) which are readily processable in conventional soap machinery while still showing significant benefit agent deposition (i.e., comparable to deposition obtained in liquid body washes).

Figure 1:
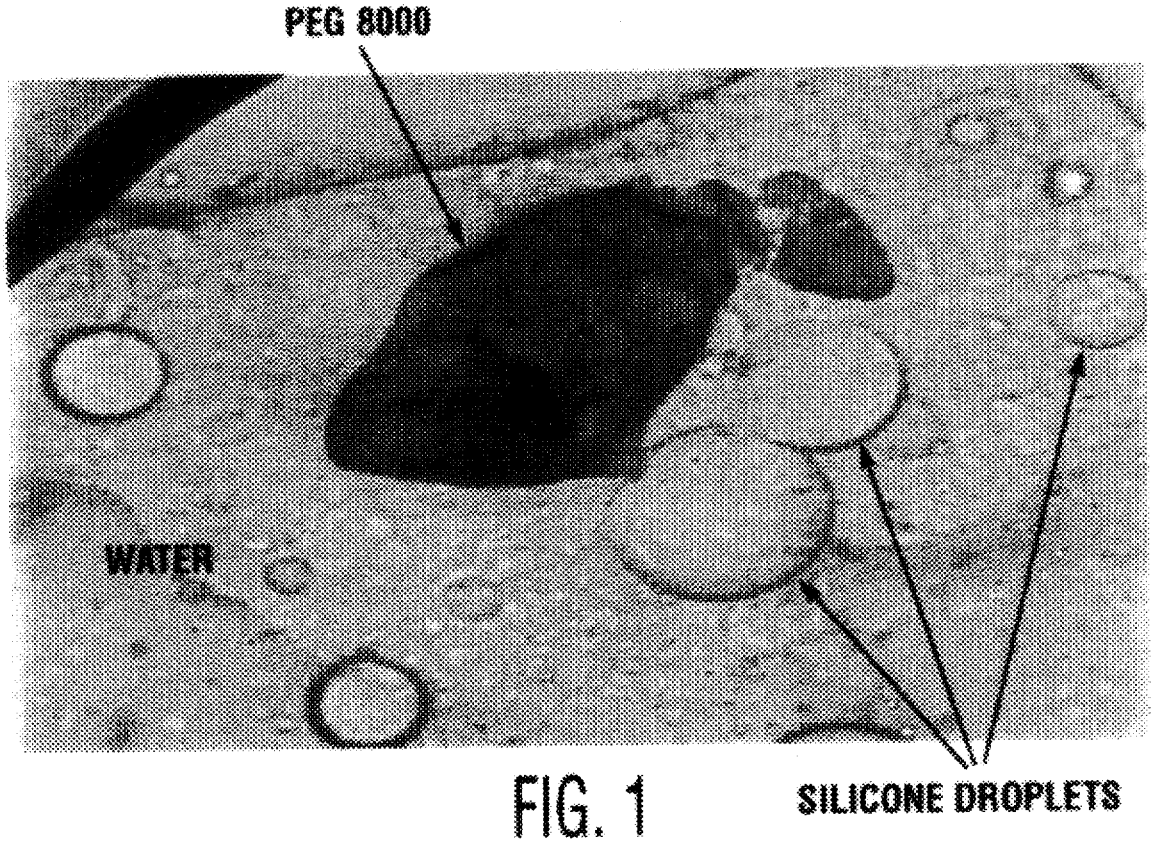
FIG. 1 is a micrograph of a chip produced following process described in U.S. Pat. No. 5,154,849 to Visscher et al. wherein the chip is flooded with water and photographed under a microscope. The silicone does not form discrete particles but forms a large layer of silicone surrounding the polyalkylene glycol. The viscous silicone gets caught in machinery and inhibits processing.
Figure 2:
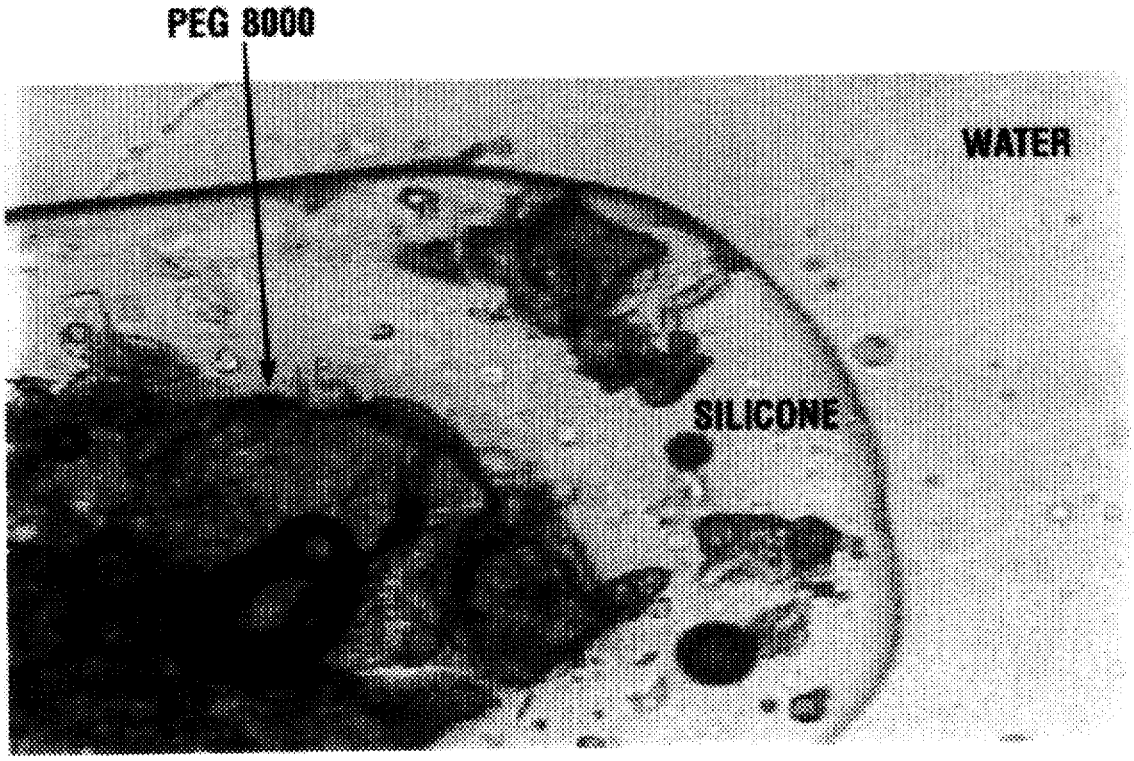
FIG. 2 is a micrograph of a chip product according to the subject invention. As noted, the benefit agent is found in discrete drops. Further, it is obvious, there is far less benefit agent present (e.g., to interfere with processing) than in FIG. 1.

As seen from FIGS. 1 and 2, by carefully controlling the level of benefit agent (so that it cannot exceed the level of alkylene glycol carrier) and by utilizing fumed silica (while not wishing to be bound by theory, it is believed the fumed silica forms three dimensional networks, altering flow properties of, for example, silicone, and causes thickening), applicants have been able to provide discrete droplets of benefit agent so that the agent is unable to stick to the machinery and significantly inhibits processing.

CHIP COMPOSITION

Polyalkylene Glycol

The first component of the chip composition is the polyalkylene glycol carrier. This carrier should comprise about 40% to 80% by wt., preferably about 50% to 70% by wt. of the chip composition. Preferably, the polyalkylene glycol should have a molecular weight greater than 4,000 to about 100,000, preferably 4,000 to 10,000. An especially preferred carrier is polyethylene glycol, for example Carbowax PEG 8800$^{(R)}$ from Union Carbide.

Benefit Agent

The benefit agent "composition" of the subject invention may be a single benefit agent component or it may be a benefit agent compound added via a carrier. Further the benefit agent composition may be a mixture of two or more compounds one or all of which may have a beneficial aspect. In addition, the benefit agent itself may act as a carrier for other components one may wish to add to the bar composition.

The benefit agent can be an "emollient oil" by which is meant a substance which softens the skin (stratum corneum) by increasing into water content and keeping it soft by retarding decrease of water content.

Preferred emollients include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudo-ceramides as described in European Patent Specification No. 556,957;

(k) vitamins such as vitamin A and E, and vitamin alkyl esters, including those vitamin C alkyl esters;

(l) sunscreens such as octyl methoxyl cinnamate (Parsol MCX) and butyl methoxy benzoylmethane (Parsol 1789);

(m) phospholipids; and (n) mixtures of any of the foregoing components.

A particularly preferred benefit agent is silicone, preferably silicones having viscosity greater than about 10,000 centipoise. The silicone may be a gum and/or it may be a mixture of silicones. One example is polydimethylsiloxane having viscosity of about 60,000 centistokes.

The benefit agent generally comprises about 10% to 40%, preferably 20% to 40%, most preferably 25% to 40% by weight of the chip composition.

Fumed Silica

Fumed silica is generally produced by the hydrolysis of silicon tetrachloride vapor in a flame of hydrogen and oxygen. The process produces particles of from about 7 to 30 millimicrons.

The enormous surface area and chain forming abilities are believed to allow it to form three-dimensional networks, altering flowing properties i.e., cause thickening.

Fumed silica will generally comprise the 0.01 to 10% by wt. of the composition, preferably 1% to 7% by wt., most preferably 1% to 5% by wt. of the composition.

Other Components

Water comprises 0 to 10%, preferably 0% to 8% by wt., most preferably 0.1 to 5% by wt. of the chip composition. It is sometimes preferred to have little or no additional water (other than that inherently present in the compounds) in the chip mixture because this may sometimes cause processing difficulties.

In addition the chip composition may comprise 0% to 15%, preferably 2% to 10% fatty acid, i.e., $C_8$to $C_{22}$ fatty acid. Generally, this is a straight chain, saturated fatty acid although this is not necessarily the case. The fatty acid helps to modify the wear rate of the emollient chip to better match that of the base soap.

BAR COMPOSITIONS

In a second embodiment of the invention, the invention comprises extruded bar compositions in which 20% to about 40% of the chips used to make the final bars comprise the benefit agent additives (i.e. chips) described above and in which 80% to 60% of the chips comprise chips which comprise the surfactant system defining the final bar.

Specifically, the surfactant system chips comprise about 5% to 90% by wt. of a surfactant system wherein the surfactant is selected from the group consisting of soap (pure soap surfactant systems are included), anionic surfactant, nonionic surfactant, amphoteric zwitterionic surfactant, cationic surfactant and mixtures thereof. These chips may additionally comprise other components typically found in final bar compositions, for example, minor amounts of fragrance, preservative, skin feel polymer etc.

Surfactant System

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1% to about 25% of the soap may be potassium soaps. The soaps useful herein are the well known alkali metal salts of natural of synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12 to 18 carbon atoms.

Coconut oil employed for the soap may be substituted in whole or in part by other "high-alluric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^4O_2CCH_2CH(SO_3M)CO_2M;$$

and amide-MEA sulfosuccinates of the formula;

$$R^4CONHCH_2CH_2O_2CCH_2CH(SO_3M)CO_2M$$

wherein $R^4$ ranges from $C_8$–$C_{22}$ alkyl and M is a solubilizing cation.

Sarcosinates are generally indicated by the formula:

$$R^1CON(CH_3)CH_2CO_2M,$$

wherein $R^1$ ranges from $C_8$–$C_{20}$ alkyl and M is a solubilizing cation.

Taurates are generally identified by formula:

$$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total bar composition. Preferably, this component is present from about 30% to about 60%.

The acyl isethionate may be an alkoxylated isethionate such as is described in Ilardi et al., U.S. Pat. No. 5,393,466, hereby incorporated by reference. This compound has the general formula:

$$R-\overset{\overset{\displaystyle O}{\|}}{C}-O-\overset{\overset{\displaystyle X}{|}}{CH}-CH_2-(\overset{\overset{\displaystyle Y}{|}}{O}CH-CH_2)_m-SO_3M^+$$

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

$$R^1\!+\!\overset{\overset{\displaystyle O}{|}}{C}-NH-(CH_2)_n\!+\!\underset{\underset{\displaystyle R^3}{|}}{\overset{\overset{\displaystyle R^2}{|}}{N^+}}-X-Y$$

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

$$R^1-\underset{\underset{\displaystyle R^3}{|}}{\overset{\overset{\displaystyle R^2}{|}}{N^+}}-CH_2CO_2^-$$

and amido betaines of formula:

$$R^1-CONH(CH_2)_n-\underset{\underset{\displaystyle R^3}{|}}{\overset{\overset{\displaystyle R^2}{|}}{N^+}}-CH_2CO_2^-$$

where n is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

$$R^1-\underset{\underset{\displaystyle R^3}{|}}{\overset{\overset{\displaystyle R^2}{|}}{N^+}}-(CH_2)_3SO_3^-$$

or $$R^1-CONH(CH_2)_m-\underset{\underset{\displaystyle R^3}{|}}{\overset{\overset{\displaystyle R^2}{|}}{N^+}}-(CH_2)_3SO_3^-$$

where m is 2 or 3, or variants of these in which $—(CH_2)_3SO_3^-$ is replaced by $$-CH_2\overset{\overset{\displaystyle OH}{|}}{C}HCH_2SO_3^-$$

In these formulae $R^1$, $R^2$ and $R^3$ are as discussed previously.

The nonionic which may be used as the second component of the invention include in particular the reaction products of compounds having a hydrophobic group and a reactive hydrogen atom, for example aliphatic alcohols, acids, amides or alkylphenols with alkylene oxides, especially ethylene oxide either alone or with propylene oxide. Specific nonionic detergent compounds are alkyl ($C_6$–$C_{22}$) phenols ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Vol. I & II) by Schwartz, Perry & Berch, both of which are also incorporated into the subject application by reference.

Although the bar may be a pure soap bar, preferably the surfactant system of this chip (forming the surfactant system in the bar) comprises:

(a) a first synthetic surfactant which is anionic; and (b) a second synthetic surfactant selected from the group consisting of a second anionic different from the first, a nonionic, an amphoteric and mixtures thereof.

The first anionic can be any of those recited above, but is preferably a $C_8$ to $C_{18}$ isethionate as discussed above. Preferably acyl isethionate will comprise 10% to 90% by wt. total bar composition.

The second surfactant is preferably a sulfosuccinate, a betaine or mixtures of the two. The second surfactant or mixture of surfactant will generally comprise 1% to 10% total bar composition. A particularly preferred composition comprises enough sulfosuccinate to form 3–8% total bar compositions and enough betaine to form 1–5% of total bar composition.

Processing

In general, the additive, benefit agent chips are formed by mixing the ingredients in a mixer at a temperature just above the melting point of the polyalkylene glycol (e.g., about 50° C. and above, generally no higher than about 110° C.) for about 1 to 60 minutes, and then cooling in a chill roll. Order of addition is not critical. The "non" benefit agent chips are formed by similarly mixing and cooling.

The chips are than combined, for example, in a hopper or ribbon mixer where they may be refined (e.g., worked into a more pliable mass), plodded into billets, stamped and cut.

In a third embodiment of the invention, the invention relates to a method of forming additives (chips) containing a benefit agent which method comprises:

(a) mixing polyalkylene glycol, benefit agent, fumed silica, optional water and optional fatty acid in a container for 1 to 60 minutes at about above 50° C.; and (b) cooling the mixture on a chill roll to about 0° to 25° C. to form chips.

The following examples are intended to further illustrate the invention and are not intended to limit the invention in any way.

Unless stated otherwise, all percentages are intended to be percentages by weight.

EXAMPLES

Protocol

Silicone measurement was conducted as follows:

Analysis is done by method known as ICP (Inductively Coupled Argon Plasma). This procedure required a step involving extraction with xylene, and is therefore currently used only in-vitro. The ICP technique employed a Thermo Jarrell Ash Atom Scan 25 with measurements being made at 251.612 nm. Additional ICP measurement parameters are given below.

The treatment process was as follows:

The porcine skin was shaved, dermatomed, and sectioned into 25 cm pieces prior to treatment. The skin sample was then treated by rubbing the bar sample across the skin 10 times, in a back and forth motion. The resulting liquor on the skin was lathered for 30 seconds and then rinsed for 10 seconds with water which was regulated at 90°–95° F. The treated skin sample was placed in a borosilicate scintillation vial that contained 10 ml of xylene. The samples were placed on a platform shaker for 1 hour to allow for the extraction of the silicone. After the extraction period, the skin was removed from the vial and the extract was analyzed using ICP technique. Sample solutions were tested against a 10 pm silicone standard.

Typical ICP Measurement Parameters for Measuring Silicone in Xylene

| | |
|---|---|
| Torch gas flow | high |
| Auxiliary gas flow | 1.5 L/min |
| Analyzer pump rate | 0.9 m L/min |
| Nebulizer pressure | 21 psi |
| Observation height | 12 mm above load cell |
| Plasma power | 1750 W |
| Wavelength | 251.612 nm |
| Slit height | 6 mm |
| Integration time | 4 sec |

Example 1

Using the protocol discussed above, benefit agent deposition (e.g., deposition of silicone) was measured in compositions representing (1) the bar of Visscher et al. with no fumed silica chips; (2) the bars of the invention which did contain fumed silica chips; and (3) a liquid body wash composition. Each is discussed in greater detail below:

(1) Visscher Bar (WO 92/08444)

The Visscher bar was obtained following the procedure taken from WO 92/08444 (equivalent to U.S. Pat. No. 5,154,849) where polyethylene glycol is used as a carrier for silicone in bars (procedure was done in a Patterson mixture). Procedure was as follows:

(a) 681 gm of Carbowax PEG 8000 was melted and held around 60° C.;

(b) 400 gm of GE 350 cps silicone was added; and (c) 273 gm of GE 500,000 cps silicone was added.

(The patent explains the carrier to be 10:9 silicone A:PEG where silicone A is a blend of 40:60 silicone gum, 500,000 cps to silicone fluid, 350 cps)

The mixture remained in the mixer for 45 minutes until it was considered homogenous. The mixture was then removed and placed on a chill roll set at 7° C. The resulting "chips" were soft, pliable and severely tacky. Silicone covered the entire surface of the equipment.

A sample bar was prepared by chip mixing surfactant chip: Visscher chip ratio of 4:1 (wherein surfactant chip comprises 40–60% fatty acid isethionate, 20–30% fatty acid, 1–10% sodium isethionate, 1–10% sulfosuccinate, about 5% betaine, preservatives, dyes and minors); and extruding into a billet with a Weber Selander plodder. The resulting billet was soft and from experience not considered a viable product. The pressed bar lathered poorly. From experience this type of "chip" cannot be produced using conventional equipment.

More specifically, mixing surfactant chips and Visscher chips at a weight ratio of 4:1, respectively, resulted in large, non-free flowing clumps which adhered together by surface silicone. This result impeded feeding into the extruder. Material which did feed was extruded as a soft, sticky billet. When stamped, the bar had a poor surface, was tacky and produced little lather when wetted.

(2) Bar of the Invention

The bar of the invention comprised a 70%/30% mixture of chips wherein the 30% additive chip component had the following formulation range:

40–100%, preferably 40–80% polyethyleneglycol (e.g. PEG 8000);

10–50%, preferably 10–40% polydimethyl siloxane of 60,000 centistokes;

0.1 to 10%, preferably 1 to 5% Cab-o-sil$^{(R)}$ fumed silica (e.g., fumed silica 45-5);

0–20%, preferably 1–10% deionized water; and

0–20%, preferably 0–10% to $C_8$ to $C_{22}$ fatty acid and the 70% surfactant chips were like the surfactant chips used in the Visscher et al. bar, as follows:

about 40–60% by wt. fatty acid isethionate;
about 20–30% by wt. fatty acid;
about 1–10% by wt. sodium isethionate
about 1–10% by wt. sulfosuccinate;
about 5% by wt. betaine; and
remainder preservative, dyes, water and other minors.

A preferred benefit agent chip comprises as follows:

(a) 55–65% PEG
(b) 25–40% silicone
(c) 1–7% silica; and
(d) 0–8% deionized water.

The chips were mixed, plodded together at the above-identified ratios, and extruded into bars.

(3) Liquid Body Wash

The liquid body wash had the following formulation:

| | % by wt. |
|---|---|
| Betaine | 5–15% |
| Sodium Cocoyl Isethionate | 1–10% |
| Anionic | 1–5% |
| Fragrance, preservatives | 0.1–2.0% |
| Water | to balance |

As noted deposition results were taken using the ICP techniques discussed and results set forth as follows:

| | Deposition. |
|---|---|
| Visscher Bar | 2.16 +/– 0.48 μg/cm$^2$ |
| Bar of Invention | 2.24 +/– 0.83 μg/cm$^2$ |
| Liquid | 2.14 +/– 0.62 μg/cm$^2$ |

It is surprising that the bar can deposit as well as the liquids. Moreover, in contrast to Visscher, the bar of the invention was readily processable and did not clog machinery (See Example 2).

Example 2

To further show differences between the bar of the invention and bars of Visscher, applicants decided to analyze the chips more closely.

Chips used in formation of the Visscher et al. bar, and chips carrying benefit agent and used in the formation of the bars of the invention were micrographed.

As seen from FIGS. 1 and 2, the Visscher et al. (P&G) chips show large "blobs" of silicone surrounding the alkylene glycol while the chips of the invention show small discrete droplets of silicone.

While not wishing to be bound by theory, it is believed the difference in amount of silicone and how it is formed accounts for the tremendous processing difficulties experienced in forming the P&G bars relative to those of the invention. As noted above, 4:1 ratio of Visscher chips to surfactant chips formed large non-free flowing clumps which hindered chip feeding into the extruder and noodle processing. The clumps also caused agglomeration in the vacuum chamber which significantly reduced billet formation. Further, as noted, material which did extrude was soft and sticky and, when stamped, the bar had a poor surface, was tacky and produced little lather when wetted.

We claim:

1. An extruded toilet bar composition comprising 20–40% by wt. of a first chip comprising:

(a) 40% to about 80% by wt. of chip composition of a polyalkylene glycol having a molecular weight from about 4,000 to 20,000;

(b) 10% to 40% by wt. of chip composition of a silicone benefit agent;

(c) 0.01% to 10% by wt. of chip composition of a fumed silica;

(d) 0% to 10% by wt. of chip composition of water; and (e) 0% to 15% by wt. of chip composition of a $C_8$ to $C_{22}$ fatty acid;

and 80% to 60% by wt. of a second chip comprising 5% to 90% by wt. of a surfactant system wherein the surfactant is selected from the group consisting of soap, anionic surfactant, nonionic surfactant, amphoteric surfactant, cationic surfactant and mixtures thereof.

2. A composition according to claim 1, wherein the surfactant system comprises (a) a first anionic surfactant; and (b) a second surfactant selected from the group consisting of a second anionic different from the first, a nonionic, an amphoteric and mixtures thereof.

3. A composition according to claim 2, wherein the first anionic is acyl isethionate.

4. A composition according to claim 3, wherein the isethionate forms 10% to 70% by weight of the final bar composition.

5. A composition according to claim 2, wherein the second surfactant is sulfosuccinate.

6. A composition according to claim 2, wherein the second surfactant is betaine.

7. A composition according to claim 6, wherein the betaine is amidococoylbetaine.

8. A composition according to claim 2, wherein the second surfactant comprises a mixture of sulfosuccinate and betaine.

9. A composition according to claim 1, wherein the polyalklene glycol is polyethylene glycol.

* * * * *